US006419453B2

(12) United States Patent
Fukui et al.

(10) Patent No.: US 6,419,453 B2
(45) Date of Patent: Jul. 16, 2002

(54) STEAM TURBINE ROTOR SHAFT

(75) Inventors: Yutaka Fukui, Hitachi; Hiroyuki Doi, Tokai; Masahiko Arai, Hitachi; Ryo Hiraga, Hitachiota; Kenichiro Nomura, Hitachi; Toshio Fujita, Tokyo; Yasuhiko Tanaka, Muroran, all of (JP)

(73) Assignees: Hitachi, Ltd.; The Japan Steel Works, Ltd., both of Tokyo (JP)

( * ) Notice: Subject to any disclaimer, the term of this patent is extended or adjusted under 35 U.S.C. 154(b) by 0 days.

(21) Appl. No.: 09/797,989

(22) Filed: Mar. 5, 2001

(30) Foreign Application Priority Data

Mar. 7, 2000 (JP) ..... 2000-067183

(51) Int. Cl.[7] ..... B63H 1/26

(52) U.S. Cl. ..... 416/241 R; 415/200; 148/325; 420/38

(58) Field of Search ..... 416/244 A, 244 R, 416/241 R; 415/200, 216.1, 199.4, 199.5; 148/325; 420/38

(56) References Cited

U.S. PATENT DOCUMENTS

| | | | | |
|---|---|---|---|---|
| 4,034,588 A | * | 7/1977 | Way et al. | 72/209 |
| 5,415,706 A | * | 5/1995 | Scarlin et al. | 148/325 |
| 6,004,507 A | * | 12/1999 | Morando | 420/586 |
| 6,030,469 A | * | 2/2000 | Ernst et al. | 148/325 |

FOREIGN PATENT DOCUMENTS

| | | |
|---|---|---|
| JP | 4-147948 | 5/1992 |
| JP | 8-30249 | 3/1996 |

OTHER PUBLICATIONS

Conference Proceedings of Advanced Heat Resistant Steels for Power Generation, organized by IOM Communications Ltd., Apr. 27–79, 1998, San Sebastian, Spain, pp. 418–429.

* cited by examiner

*Primary Examiner*—Edward K. Look
*Assistant Examiner*—James M McAleenan
(74) *Attorney, Agent, or Firm*—Mattingly, Stanger & Malur, P.C.

(57) ABSTRACT

The main object of the present invention is to provide a steam turbine rotor shaft whose high-temperature strength is excellent at a selected temperature of 650 degrees C.

A steam turbine rotor shaft comprising 0.05% to 0.20% by weight of carbon, 0.20% or less by weight of silicon, 0.05% to 1.5% by weight of manganese, 0.01% to 1.0% by weight of nickel, 9.0% to 13.0% by weight of chrome, 0.05% to 2.0% by weight of molybdenum, 0.5% to 5.0% by weight of tungsten, 0.05% to 0.30% by weight of vanadium, 0.01% to 0.20% by weight of niobium, 0.5% to 10.0% by weight of cobalt, 0.01% to 0.1% by weight of nitrogen, 0.001% to 0.030% by weight of boron, 0.0005% to 0.006% by weight of aluminum, and the remaining parts substantially comprising iron and inevitable impurities.

5 Claims, No Drawings

STEAM TURBINE ROTOR SHAFT

BACKGROUND OF THE INVENTION

1. Field of the Invention

The present invention relates to a rotor shaft for a high-strength steam turbine fit for a new thermal power plant, more particularly fit for a ultra-super critical pressure thermal power plant.

2. Description of the Prior Art

For higher efficiency of power generation, the recent thermal power plants have used higher temperature and higher pressure. For example, recent steam turbines use steam of about 600 degrees C which is the highest steam temperature at present. In the near future, steam of 650 degrees C will be used. To use steam of such a high-temperature, the conventional heat-resisting ferrite steel must be substituted by high heat-resisting materials whose strength is excellent at such a high temperature. Some of austenite heat-resisting alloys are superior at such a high temperature, but their thermal fatigue strengths are inferior because their coefficients of thermal expansion are very big.

Some examples of new heat-resisting ferrite steel whose strength at a high temperature is improved are disclosed by Japanese Non-examined Patent Publications No.04-147948 (1992) and No.08-30249(1996).

However, when used for a long time at an extremely high steam temperature of 650 degrees C, these proposed alloys containing much tungsten produce fragile intermetallic compounds which reduce the long-term creep rupture strength. Therefore, these alloys are still not perfect as materials to be used at an extremely high vapor temperature. The world has expected high heat-resisting ferrite steel whose strength is extremely stable for a long time at such a high temperature.

SUMMARY OF THE INVENTION

The main object of the present invention is to provide a rotor shaft for a high-temperature steam turbine which is very strong for a long time at a selected temperature of 650 degrees or above.

It is an object of the present invention to provide a steam turbine rotor shaft comprising martensite steel containing 0.05% to 0.20% by weight of carbon, 0.20% or less by weight of silicon, 0.05% to 1.5% by weight of manganese, 0.01% to 1.0% by weight of nickel, 9.0% to 13.0% by weight of chrome, 0.05% to 0.5% by weight of molybdenum, 0.5% to 5.0% by weight of tungsten, 0.05% to 0.30% by weight of vanadium, 0.01% to 0.20% by weight of niobium, 0.5% to 10.0% by weight of cobalt, 0.01% to 0.1% by weight of nitrogen, 0.001% to 0.030% by weight of boron, and 0.0005% to 0.006% by weight of aluminum, wherein the remaining parts of this steel substantially comprise iron.

It is another object of the present invention to provide a steam turbine rotor shaft comprising martensite steel containing 0.09% to 0.15% by weight of carbon, 0.03% to 0.15% by weight of silicon, 0.35% to 0.65% by weight of manganese, 0.02% to 0.5% by weight of nickel, 9.5% to 11.5% by weight of chrome, 0.05% to 0.4% by weight of molybdenum, 1.0% to 3.0% by weight of tungsten, 0.15% to 0.30% by weight of vanadium, 0.04% to 0.13% by weight of niobium, 1.5% to 3.5% by weight of cobalt, 0.01% to 0.04% by weight of nitrogen, 0.005% to 0.025% by weight of boron, and 0.0005% to 0.005% by weight of aluminum; wherein the remaining parts of this steel substantially comprise iron.

It is yet a further object of the invention to provide a steam turbine rotor shaft comprising martensite steel containing 9.0% to 13.0% by weight of chrome, 0.5% to 5.0% by weight of tungsten, 0.05% to 0.30% by weight of vanadium, 0.01% to 0.20% by weight of niobium, 0.5% to 10.0% by weight of cobalt, and 0.001% to 0.030% by weight of boron; wherein the creep rupture strength at 650 degrees C for 100,000 hours is 9 $kg/mm^2$ or more preferentially 10 $kg/mm^2$. More preferentially said rotor shaft comprises a martensite steel having the above composition and the creep rupture strength for 100,000 hours is 20 $kg/mm^2$ or more at 600 degrees C, 14 $kg/mm^2$ or more at 625 degrees C, 25 $kg/mm^2$ or more at 700 degrees C, more preferentially 22 $kg/mm^2$ or more at 600 degrees C, 16 $kg/mm^2$ or more at 625 degrees C, 3 $kg/mm^2$ or more at 700 degrees C.

It is a more particular object of the invention to provide a steam turbine rotor shaft comprising martensite steel containing 0.09% to 0.15% by weight of carbon, 0.15% or less by weight of silicon, 0.3% to 0.7% by weight of manganese, 0.02% to 0.5% by weight of nickel, 9.0% to 13.0% by weight of chrome, 0.05% to 0.5% by weight of molybdenum, 1.0% to 3.0% by weight of tungsten, 0.15% to 0.30% by weight of vanadium, 0.04% to 0.13% by weight of niobium, more than 1.5% to 4.0% or less by weight of cobalt, 0.01% to 0.04% by weight of nitrogen, 0.001% to 0.030% by weight of boron, and 0.0005% to 0.006% by weight of aluminum; wherein the remaining parts of this steel substantially comprise iron.

It is still another object of the invention to provide a steam turbine rotor shaft comprising martensite steel containing 0.05% to 0.20% by weight of carbon, 0.20% or less by weight of silicon, 0.05% to 1.5% by weight of manganese, 0.01% to 1.0% by weight of nickel, 9.0% to 13.0% by weight of chrome, 0.05% to 2.0% by weight of molybdenum, 0.5% to 5.0% by weight of tungsten, 0.05% to 0.30% by weight of vanadium, 0.01% to 0.20% by weight of niobium, more than 1.0% to 10.0% or under by weight of cobalt, 0.01% to 0.1% by weight of nitrogen, 0.001% to 0.030% by weight of boron, and 0.0005% to 0.006% by weight of aluminum; wherein the remaining parts of this steel substantially comprise iron.

Carbon is an indispensable element to assure quenching, to separate carbides of $M_{23}C_6$ in the tempering processes, and thus to increase the high-temperature strength of the steel. The martensite steel of the present invention requires a minimum of 0.05% by weight of carbon.

More than 0.20% by weight of carbon causes excessive separation of $M_{23}C_6$ carbides and reduction of the degree of matrix. This lessens the high-temperature strength of the steel when used for a long time. The martensite steel of the present invention uses 0.05% to 0.20% by weight of carbon, more preferentially 0.09% to 0.13%.

Manganese(Mn) suppresses production of δ ferrite and accelerates separation of carbides of $M_{23}C_6$. The martensite steel of the present invention requires a minimum of 0.05% by weight of manganese, usually 0.02% to 1.5%, preferentially 0.3% to 0.7%, more preferentially 0.35% to 0.65%. 1.5% by weight or above of manganese in the steel will reduce the resistance to oxidization. Nickel(Ni) suppresses production of δ ferrite and adds toughness to the steel. The martensite steel of the present invention requires a minimum of 0.05% by weight of nickel.

More than 1.0% by weight of nickel reduces the creep rupture strength at 620 degrees C or above. The martensite steel of the present invention uses 0.02% to 1.0% by weight of nickel, more preferentially 0.1% to 0.5%.

Chrome(Cr) is an indispensable element to increase the resistance to oxidization of the steel, to separate $M_{23}C_6$ carbides, and thus to increase the high-temperature strength of the steel. The martensite steel of the present invention requires a minimum of 9% by weight of chrome.

More than 13% by weight of chrome causes production of δ ferrite and reduces strength and toughness at high temperatures. The martensite steel of the present invention uses 9.0% to 13.0% by weight of carbon, preferentially 9.5% to 11.5%, more preferentially 10.0% to 11.0%.

Molybdenum(Mo) accelerates separation of fine particles of $M_{23}C_6$ carbides and prevents them from cohering. Consequentially, molybdenum Mo is effective to give high strength at a high temperature for a long time. The martensite steel of the present invention requires a minimum of 0.05% by weight of molybdenum. 2% or above by weight of molybdenum causes easy production of δ ferrite. The martensite steel of the present invention uses 0.05% to 2.0% by weight of molybdenum, preferentially 0.05% to 0.5%, more preferentially 0.1% to 0.3%.

Tungsten(W) is more effective than molybdenum to suppress cohesion of $M_{23}C_6$ carbide particles, to solidify and strengthen the matrix and to increase the high-temperature strength of the steel. The martensite steel of the present invention requires a minimum of 0.5% by weight of tungsten. 5% or above by weight of tungsten causes easy production of δ ferrite and laves phases, which decreases the high-temperature strength of the steel. The martensite steel of the present invention preferentially uses 1.0% to 3.0% by weight of tungsten.

Vanadium(V) is effective to separate vanadium carbides and increase the high-temperature strength of the steel. The martensite steel of the present invention requires a minimum of 0.05% by weight of vanadium. More than 0.3% by weight of vanadium settles excessive carbons in the steel, separates less $M_{23}C_6$ carbides, and reduces the high-temperature strength of the steel. The martensite steel of the present invention preferentially uses 0.05% to 0.3% by weight of vanadium, more preferentially 0.10% to 0.25%.

At least one of niobium(Nb) and tantalum(Ta) works to produce NbC or TaC and make the crystal particles smaller. Part of niobium Nb and tantalum Ta dissolves during quenching and separates NbC and TaC in the tempering process. This increases the high-temperature strength of the steel. The martensite steel of the present invention requires a minimum of 0.01% by weight of niobium Nb and tantalum Ta. More than 0.20% by weight of niobium Nb and tantalum Ta as well as vanadium settles excessive carbons in the steel, separates less $M_{23}C_6$ carbides, and reduces the high-temperature strength of the steel. The martensite steel of the present invention preferentially uses 0.01% to 0.20% by weight of niobium Nb and tantalum Ta, more preferentially 0.04% to 0.13%.

Cobalt (Co) is an important element which distinguishes the present invention from the conventional inventions. This invention uses 0.5% by weight or above of cobalt and dramatically increases the high-temperature strength of the steel. This effect is assumed to be caused by an interaction of cobalt and tungsten and is a symptom characteristic to the alloy containing 0.5% by weight or more of tungsten in accordance with the present invention. An excessive addition of cobalt (10% by weight or above) will decrease the ductility of the steel and is not preferable. The martensite steel of the present invention preferentially uses more than 1.0% to 4.0% or under by weight of cobalt, more preferentially 1.5% to 3.5%.

Nitrogen(N) is effective to separate nitride of vanadium and to increase the high-temperature strength by the IS effect (interaction of invasion type solid solution elements and substitution type solid solution elements) together with molybdenum(Mo) and tungsten W in the solid solution status. The martensite steel of the present invention requires a minimum of 0.01% by weight of nitrogen N. More than 0.1% by weight of nitrogen reduces the ductility of the steel. The martensite steel of the present invention preferentially uses 0.01% to 0.1% by weight of nitrogen, more preferentially 0.01% to 0.04%.

Silicon(Si) accelerates production of a laves phase and reduces the ductility of the steel by segregation of grain boundaries. Therefore the quantity of silicon in the steel must be 0.15% by weight or under. more preferentially 0.01% or under. However, an extremely small quantity of silicon (0.03% by weight or above) added as a deoxidizer gives a preferable high-temperature characteristic together with an aluminum deoxidizer (to be explained later).

Aluminum(Al) plays the most important role in the preset invention. 0.0005% by weight of aluminum is added as a deoxidizer and an agent to make grains boundary smaller.

Further, aluminum working as a strong nitride producing element settles nitrogen which has an effect on creeping and consequentially decreases a long-term creep strength (10,000 hours or longer) at a high temperature of 625 degrees C to 700 degrees C (particularly when more than 0.006% by weight of aluminum is added). Furthermore, aluminum can accelerate separation of a laves phase which is a fragile intermetallic compound having tungsten as its main ingredient to the grain boundaries and reduce the creep rupture strength for a long term. Particularly, when crystal particles are made smallest, the laves phase is separated continuously to the grain boundaries. Therefore, the quantity of aluminum in the martensite steel of the present invention must be up to 0.006% by weight. The martensite steel of the present invention preferentially uses 0.001% to 0.004% by weight of aluminum. This is more effective when the quantity of tungsten in the steel is greater (1.5% to 3.0% by weight).

Boron(B) works to strengthen grain boundaries. Further, boron dissolves into $M_{23}C_6$ carbide and prevents $M_{23}C_6$ carbide particles from growing bigger. This increases the high-temperature strength of the steel. A minimum of 0.001% by weight boron in the steel is very effective but more than 0.030% by weight of boron reduces the weldability and forging ability of the steel. Therefore, the martensite steel of the present invention uses 0.001% to 0.030% by weight of boron, more preferentially 0.002% to 0.025%.

The preferential equivalent of chrome expressed by a formula below is 4% to 10.5% by weight, more particularly 6.5% to 9.5%.

$$\text{Chrome equivalent} = -40\times C\,\% - 30\times N\,\% - 2\times Mn\,\% - 4\times Ni\,\% + Cr\,\% + 6\times Si\,\% + 4\times Mo\,\% + 1.5\times W\,\% + 11\times V\,\% + 5\times Nb\,\% - 2\times Co\,\%$$

The rotor shaft of the present invention is produced by the steps of melting the ingot in a vacuum status, decarbonizing thereof in a vacuum status, ESR-dissolving, forging, heating thereof at 900 degrees C to 1150 degrees C, quenching at a cooling rate of 50 degrees C/hour to 600 degrees C/hour (in the center hole), tempering thereof at 500 degrees C to 620 degrees C, and tempering thereof again at 600 degrees C to 750 degrees C.

The rotor shaft in accordance with the present invention when applied to a ultra-super critical pressure thermal power plant can increase the steam temperature to 650 degrees C or above. This has a great effect to increase the thermal efficiency of a thermal power plant.

DESCRIPTION OF THE PREFERRED EMBODIMENTS

We prepared two kinds of rotor shafts by melting 80 tons of cast steel in the electric furnace, decarbonizing thereof in a vacuum status, casting thereof into a casting die, forging and drawing thereof into electrode bars, electrically melting thereof as electrodes, forging and drawing thereof into rotor forms (1050 mm diameter by 3700 mm long). This forging and drawing work is done at 1150 degrees C or lower to prevent forging cracks. Further this forged steel is annealed, heated to 1050 degrees C, hardening thereof by water mist, tempering thereof twice at 570 degrees C and at 700 degrees C, and cutting thereof into the preset rotor shape. This embodiment uses the upper part of the electro slag for the first blade side and the lower slag part for the final blade side. Each rotor shaft has a center hole. This center hole can be removed by eliminating the impurities. Table 1 shows the compositions (percent by weight) of the rotor shafts of the present invention.

TABLE 1

| No. | C | Si | Mn | Ni | Cr | Mo | W | V | Nb | Co | N | B | Al | Fe |
|---|---|---|---|---|---|---|---|---|---|---|---|---|---|---|
| 1 | 0.10 | 0.04 | 0.54 | 0.50 | 11.02 | 0.23 | 2.70 | 0.22 | 0.07 | 2.61 | 0.020 | 0.02 | 0.009 | Remaining part |
| 2 | 0.10 | 0.06 | 0.46 | 0.25 | 10.21 | 0.14 | 2.51 | 0.21 | 0.07 | 2.44 | 0.02 | 0.01 | 0.002 | Remaining part |

Table 2 shows creep rupture strengths of the rotor shafts at 600 degrees C to 700 degrees C for 100,000 hours. As seen from Table 2, more than 0.006% by weight of aluminum in the composition of the present invention dramatically reduces the creep rupture strength particularly at 650 degrees C. Therefore, the quantity of aluminum should be 0.006% by weight or under.

TABLE 2

| | 100,000 hours creep rupture strength | | | |
|---|---|---|---|---|
| No. | 600° C. | 625° C. | 650° C. | 700° C. |
| 1 | 20.0 | 14.0 | 8.5 | 2.5 |
| 2 | 24.0 | 17.0 | 10.0 | 4.0 |

The rotor shaft of this embodiment can be used for a high-pressure steam turbine, a medium pressure steam turbine, or a high- and medium-pressure combination steam turbine comprising both a high-pressure section and a medium-pressure section. These steam turbines contain rotor shafts having double-current type blades which flow steam to opposite outsides. Each rotor shaft has a projection of sleeve or Cr—Mo low alloy steel having a venite organization on the journal section of the rotor shaft. Particularly, the rotor shaft of the present invention is fit for a ultra-super critical pressure thermal power plant (1000 Mwatts or above per plant) using a steam temperature of 600 degrees C for a high pressure turbine, 620 degrees C for a medium pressure turbine, and 620 degrees C for a high- and medium-pressure turbine. Further, the rotor shaft of the present invention is fit for the use of steam temperatures of 630 degrees C to 650 degrees C.

What is claimed is:

1. A steam turbine rotor shaft comprising martensite steel containing 0.05% to 0.20% by weight of carbon, 0.20% or less by weight of silicon, 0.05% to 1.5% by weight of manganese, 0.01% to 1.0% by weight of nickel, 9.0% to 13.0% by weight of chrome, 0.05% to 0.5% by weight of molybdenum, 0.5% to 5.0% by weight of tungsten, 0.05% to 0.30% by weight of vanadium, 0.01% to 0.20% by weight of niobium, 0.5% to 10.0% by weight of cobalt, 0.01% to 0.1% by weight of nitrogen, 0.001% to 0.030% by weight of boron, and 0.0005% to 0.006% by weight of aluminum.

2. A steam turbine rotor shaft comprising martensite steel containing 0.09% to 0.15% by weight of carbon, 0.15% or less by weight of silicon, 0.3% to 0.7% by weight of manganese, 0.02% to 0.5% by weight of nickel, 9.0% to 13.0% by weight of chrome, 0.05% to 0.5% by weight of molybdenum, 1.0% to 3.0% by weight of tungsten, 0.15% to 0.30% by weight of vanadium, 0.04% to 0.13% by weight of niobium, more than 1.0% to 4.0% or less by weight of cobalt, 0.01% to 0.04% by weight of nitrogen, 0.001% to 0.030% by weight of boron, and 0.0005% to 0.006% by weight of aluminum.

3. A steam turbine rotor shaft comprising martensite steel containing 0.09% to 0.15% by weight of carbon, 0.03% to 0.15% by weight of silicon, 0.35% to 0.65% by weight of manganese, 0.02% to 0.5% by weight of nickel, 9.5% to 11.5% by weight of chrome, 0.05% to 0.4% by weight of molybdenum, 1.0% to 3.0% by weight of tungsten, 0.15% to 0.30% by weight of vanadium, 0.04% to 0.13% by weight of niobium, 1.5% to 3.5% by weight of cobalt, 0.01% to 0.04% by weight of nitrogen, 0.005% to 0.025% by weight of boron, and 0.0005% to 0.005% by weight of aluminum.

4. A steam turbine rotor shaft comprising martensite steel containing 9.0% to 13.0% by weight of chrome, 0.5% to 5.0% by weight of tungsten, 0.05% to 0.30% by weight of vanadium, 0.01% to 0.20% by weight of niobium, 0.5% to 10.0% by weight of cobalt, and 0.001% to 0.030% by weight of boron; wherein the creep rupture strength at 650 degrees C for 100,000 hours is 9 kg/mm$^2$.

5. A steam turbine rotor shaft comprising martensite steel containing 0.05% to 0.20% by weight of carbon, 0.20% or less by weight of silicon, 0.05% to 1.5% by weight of manganese, 0.01% to 1.0% by weight of nickel, 9.0% to 13.0% by weight of chrome, 0.05% to 2.0% by weight of molybdenum, 0.5% to 5.0% by weight of tungsten, 0.05% to 0.30% by weight of vanadium, 0.01% to 0.20% by weight of niobium, more than 1.0% to 10.0% or under by weight of cobalt, 0.01% to 0.1% by weight of nitrogen, 0.001% to 0.030% by weight of boron, and 0.0005% to 0.006% by weight of aluminum.

* * * * *